US009393477B2

(12) United States Patent
Landsman et al.

(10) Patent No.: US 9,393,477 B2
(45) Date of Patent: Jul. 19, 2016

(54) ELECTRONIC GOLFING ALIGNMENT AID AND CORRESPONDING METHOD

(71) Applicants: Stephen Landsman, Baltimore, MD (US); Richard N. Conrey, Palm Beach, FL (US)

(72) Inventors: Stephen Landsman, Baltimore, MD (US); Richard N. Conrey, Palm Beach, FL (US)

( * ) Notice: Subject to any disclaimer, the term of this patent is extended or adjusted under 35 U.S.C. 154(b) by 83 days.

(21) Appl. No.: 14/203,673

(22) Filed: Mar. 11, 2014

(65) Prior Publication Data

US 2015/0258410 A1 Sep. 17, 2015

(51) Int. Cl.
*A63B 69/36* (2006.01)
*A63B 71/06* (2006.01)

(52) U.S. Cl.
CPC ..... *A63B 69/3608* (2013.01); *A63B 71/0622* (2013.01); *A63B 2071/0625* (2013.01); *A63B 2209/08* (2013.01); *A63B 2220/12* (2013.01); *A63B 2220/16* (2013.01); *A63B 2220/18* (2013.01); *A63B 2220/836* (2013.01)

(58) Field of Classification Search
CPC ..... A63B 2220/12; A63B 2220/18; A63B 2220/836
USPC ..... 473/199, 209, 210, 212, 215, 220, 403, 473/407
See application file for complete search history.

(56) References Cited

U.S. PATENT DOCUMENTS

| | | | | |
|---|---|---|---|---|
| 5,879,239 | A * | 3/1999 | Macroglou | A63B 69/3608 473/209 |
| 5,883,861 | A * | 3/1999 | Moser | G04B 47/065 33/263 |
| 7,978,081 | B2 * | 7/2011 | Shears | A61B 5/1127 340/573.1 |
| 2009/0298605 | A1 * | 12/2009 | Wiegers | A63B 57/00 473/199 |
| 2012/0212406 | A1 * | 8/2012 | Osterhout | G02B 27/017 345/156 |

* cited by examiner

*Primary Examiner* — Nini Legesse
(74) *Attorney, Agent, or Firm* — Polsinelli PC

(57) ABSTRACT

A golfing aid system at least partially configured to be mounted on a golfer is provided. The system includes an optical system, an output configured to provide audio and/or visual information, a human wearable support, a first compass mounted on the wearable support, an optical system. The golfing aid system is configured to, when the wearable support is worn by the golfer, obtain a first compass heading from the first compass for a target location observable through the optical system, obtain a second compass heading when the golfer is in a golfing stance, determine, based on at least the first and second compass headings, whether a part of the body that supports the human wearable support is substantially in alignment with a direction, and provide feedback through the output, the feedback being configured to indicate whether or not the golfer is substantially aligned with the direction. Wherein the direction represents a substantially optimal alignment of a part of the body relative to the first compass heading to strike a golf ball along a path in alignment with the first compass heading.

13 Claims, 13 Drawing Sheets

ELECTRONIC GOLFING ALIGNMENT AID AND CORRESPONDING METHOD

FIELD OF THE INVENTION

The present invention relates to a golfing aid. More specifically, the present invention relates to a golfing aid that provides an alignment guide for the golfer to properly orient his body relative to optimal swing path for a golf ball.

BACKGROUND

The game of golf is primarily accuracy based. Referring now to FIG. 1, ultimately the golfer 100 wants to strike a ball 102 and have it land at a target landing point 104, which may be the pin 106. For ease of discussion, the pin 106 is considered herein as the target landing point, although it is to be understood that this need not be the case.

Ideally (in optimal weather conditions) the golfer wants to strike the ball along an imaginary straight line drawn from the ball 102 to the target landing point 104, referred to herein as the "correct true heading". When the golfer strikes the ball squarely along that line with a stroke exactly coincident to that line at time of impact, the trajectory towards target is optimized for that path in still weather conditions.

A methodology for aligning the body with the ball is often referred to as the "railroad tracks". The golfer approximates or judges the correct true heading, which acts as one rail of the railroad tracks. The golfer then aligns the forward ends of his feet in parallel with the selected heading, which acts as the other rail of the railroad tracks. The hands are then placed in optimal position on the club, with the hand facing the ball preferably perpendicular to the correct true heading. FIG. 2 shows the correct orientation of the golfer relative to a particular shot. If correctly aligned, the strike path of the ball 102 to the target landing point 104 is optimized for that path.

Referring now to FIGS. 3 and 4, a drawback of the above methodology is that any misalignment will cause the ball strike path to deviate from the target landing point 104. Misalignment may come from, inter alia, a poor judgment/approximation of the correct true heading, misalignment of the golfer's feet relative to parallel with the correct true heading, misalignment of the golfer's hand relative to the perpendicular to the correct true heading, etc. At 100 yards between the ball 102 and the target landing point 104, one (1) degree of misalignment translates to over five feet of lateral deviation from the intended landing point.

SUMMARY OF THE INVENTION

A golfing aid system at least partially configured to be mounted on a golfer is provided. The system includes an optical system, an output configured to provide audio and/or visual information, a human wearable support, a first compass mounted on the wearable support, an optical system. The golfing aid system is configured to, when the wearable support is worn by the golfer, obtain a first compass heading from the first compass for a target location observable through the optical system, obtain a second compass heading when the golfer is in a golfing stance, determine, based on at least the first and second compass headings, whether a part of the body that supports the human wearable support is substantially in alignment with a direction, and provide feedback through the output, the feedback being configured to indicate whether or not the golfer is substantially aligned with the direction. Wherein the direction represents a substantially optimal alignment of a part of the body relative to the first compass heading to strike a golf ball along a path in alignment with the first compass heading.

BRIEF DESCRIPTION OF THE DRAWINGS

Various embodiments in accordance with the present disclosure will be described with reference to the drawings, in which.

DETAILED DESCRIPTION

In the following description, various embodiments will be illustrated by way of example and not by way of limitation in the figures of the accompanying drawings. References to various embodiments in this disclosure are not necessarily to the same embodiment, and such references mean at least one. While specific implementations and other details are discussed, it is to be understood that this is done for illustrative purposes only. A person skilled in the relevant art will recognize that other components and configurations may be used without departing from the scope and spirit of the claimed subject matter.

Figure 5:
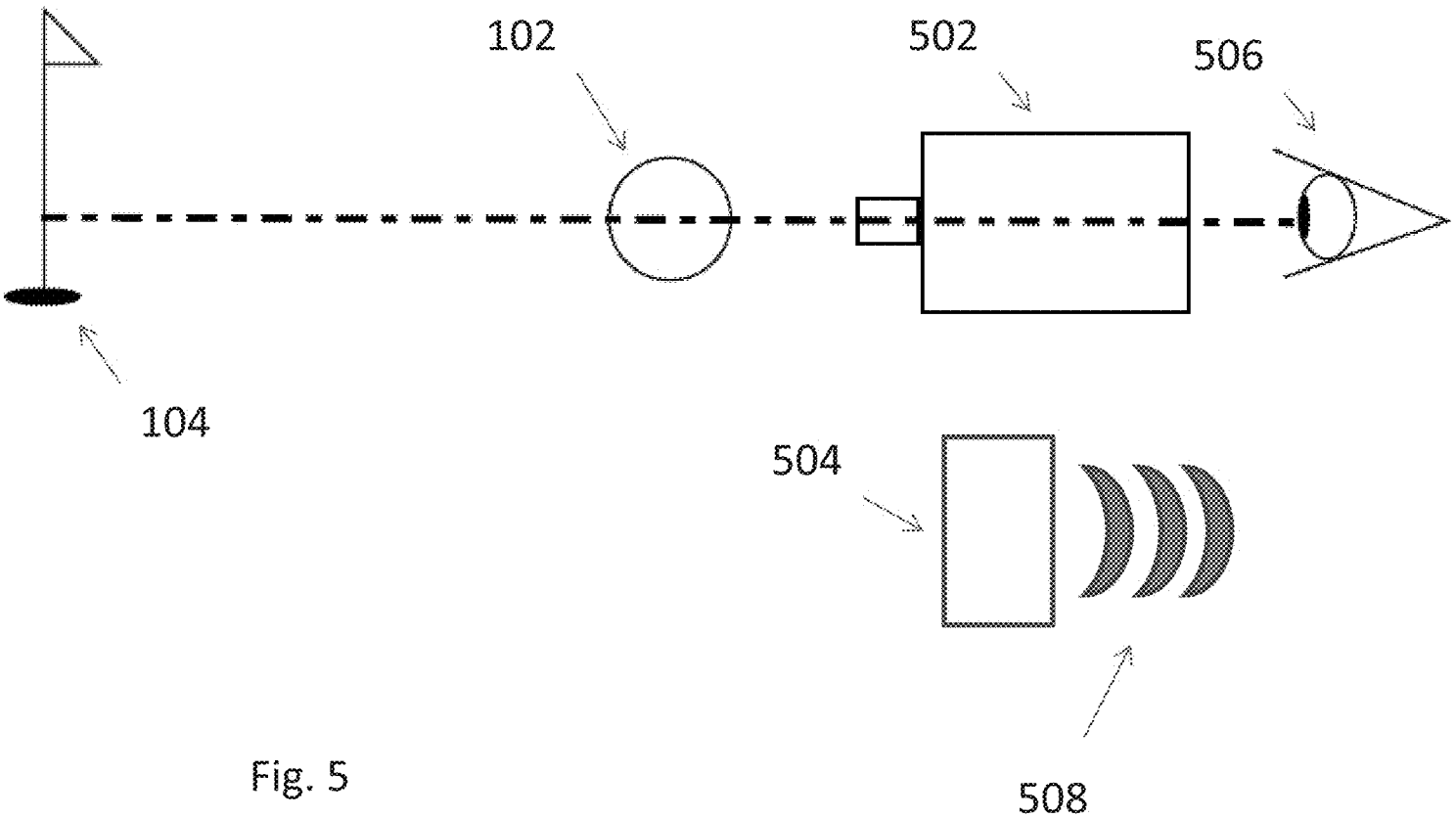
FIG. 5 illustrates a block diagram of an embodiment of the invention.

Referring now to FIG. 5, a first embodiment of the invention is shown. The embodiment includes a trajectory device 502 and an indicator 504. Trajectory device 502 will determine the correct true heading from its location to the desired landing point 104 as viewed and selected by the golfer 506 (shown in FIG. 5 as an eye). Indicator 504 will give the golfer feedback (shown in FIG. 5 as sound waves 508) on the correct body orientation relative to the correct true heading. Trajectory device 502 and indicator 504 are preferably in communication with each other, preferably wireless communication.

Figure 6:
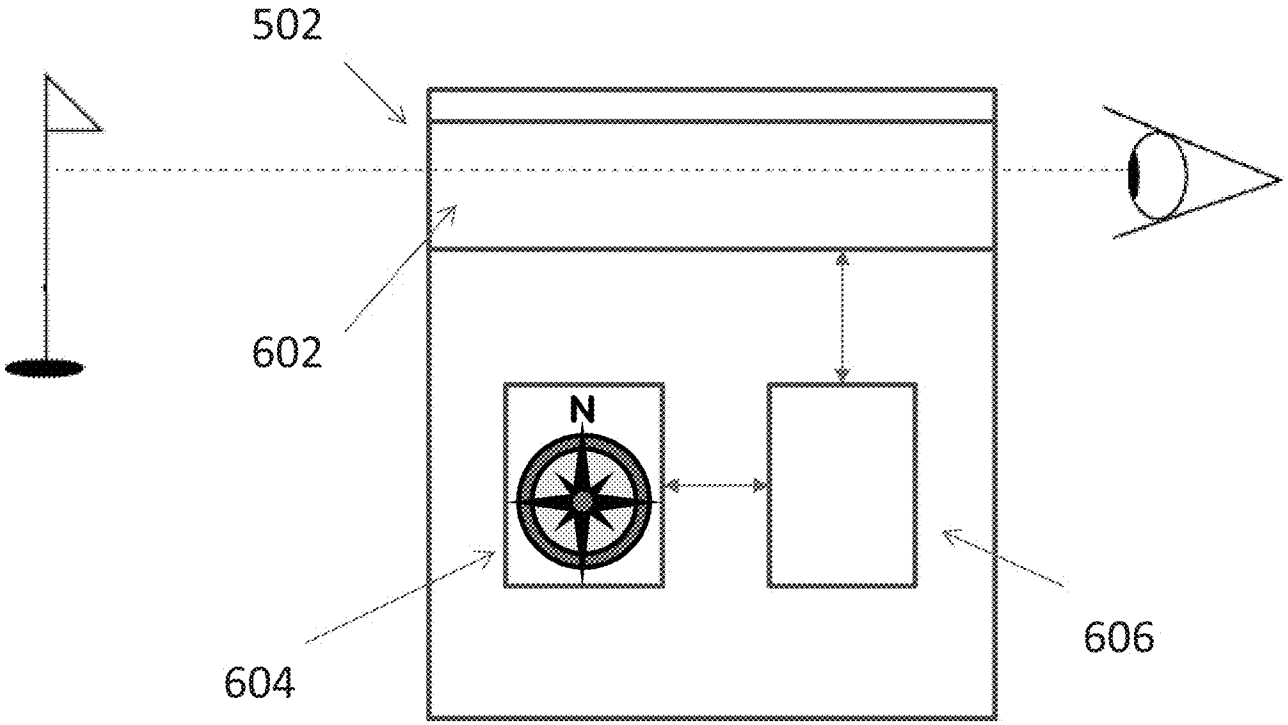
FIG. 6 illustrates a block diagram of a trajectory device in accordance with an embodiment of the invention.

Referring now to FIG. 6, an embodiment of trajectory device 502 is shown. The trajectory device includes at least an optical system 602, a digital compass 604 (e.g., GPS and/or magnetometer based), and standard mobile device components 606, which are typical hand-held computer components such as a processor, memory, input/output, battery, wireless and wired modem capability, etc. The invention is not limited to any specific architecture or configuration of these components other than as specifically noted. Based on implementation, optical system, digital compass and components 606 may partially overlap or be independent from each other.

The optical system may be optical lenses and/or digital camera components. At a most basic level, the optical system need be nothing more than alignment markers such as found in a gun sight, or an eyepiece with some type of indicator to align on a desired target, e.g., a flat transparent surface with an etched line or cross hair. In the alternative, telescoping lenses could also be provided. In yet another alternative, a digital camera with or without telescopic (optical or digital) elements could be provided with a display screen to view what the camera observes; the centering indicia could be part of the optics (e.g., etched in the lenses or the display), or added electronically by the camera software.

Figure 7:
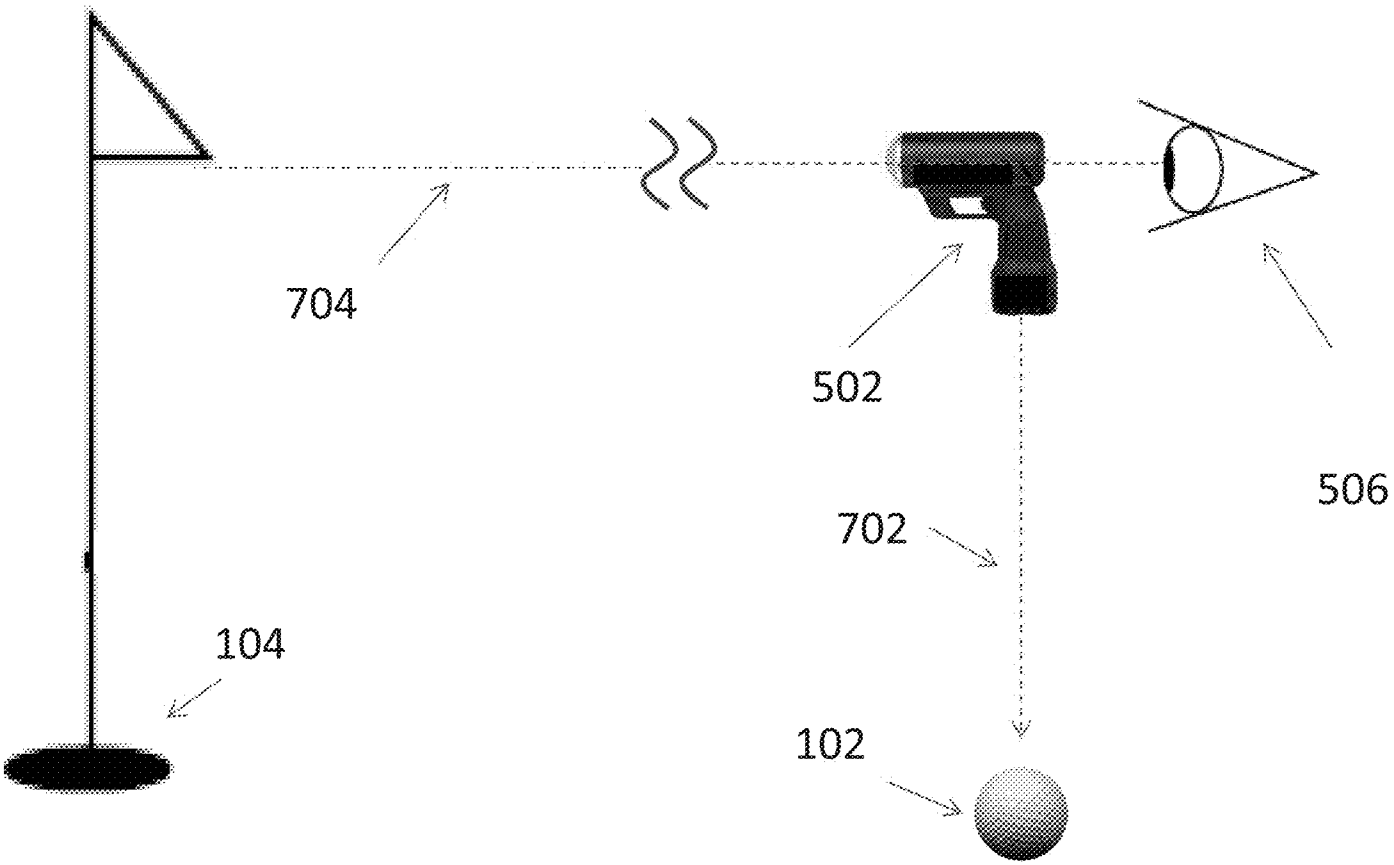
FIG. 7 illustrates a block diagram of use of the trajectory device according to an embodiment of the invention.

Referring now to FIG. 7, in operation the golfer places the trajectory device 502 above the ball 102, as shown by alignment path 702. The golfer then observes the target landing point 104 through the optical system and aligns the marker with the target landing point 104. When the desired alignment 704 is reached, then the golfer depresses a key (e.g., trigger, button) and the trajectory device 502 notes the direction of the digital compass 604 in that alignment. That recorded compass heading will be the substantially accurate correct true heading from the ball 102 to the target landing point 104, subject to alignment error (e.g., in centering over the ball 102 or in the optics, exact centering of the target landing point, and natural compass error). The noted compass heading may be stored locally in memory and/or transmitted to the indicator 504. In the alternative, the trajectory device could be placed behind or in front of ball 502 so long as placed in alignment with alignment path 702.

The physical embodiment of trajectory device 502 can take a variety of forms, as well as different combinations of hardware and software. By way of non-limiting example, in FIG. 7 the components are similar to a commercial radar gun, in which an officer can view traffic on a screen as fed from a digital camera. A trigger could be provided to note/read the direction provided by the digital compass.

By way of another non-limiting example, the trajectory device 602 could be a general mobile device, such as a smart phone or tablet. Such devices typically incorporate a digital camera, display screen and digital compass. Appropriate software (e.g., an app) could utilize these components to display the viewed target landing point 104 along with an alignment marker, and pressing a button notes the direction from the digital compass.

In the above embodiments, centering of the trajectory device above the ball 102 is largely based an approximation and judgment. Additional methodologies to improve the accuracy may not be necessary as minor deviations from proper alignment with ball 102 would have minimal impact on the resulting headings and overall effectiveness of at least some embodiments. However, to the extent that further accuracy is desired, a centering methodology may be provided. By way of non-limiting example, one such methodology would be a string or bob (preferably retractable) mounted to the trajectory device 502 (alignment 702 can be considered such a string and bob); gravity would pull the bob downward and when just over the ball would confirm alignment. Another non-limiting methodology would be adapting the optical system 602 to see both forward toward target landing point 104 and straight down to golf ball 102 (e.g., a beam splitter in the optical pathway, such as via an add-on lens attachment to a smart phone). The golfer could see both the ball 102 and target landing point 104 and confirm both are in alignment before obtaining the compass direction.

Figure 8:
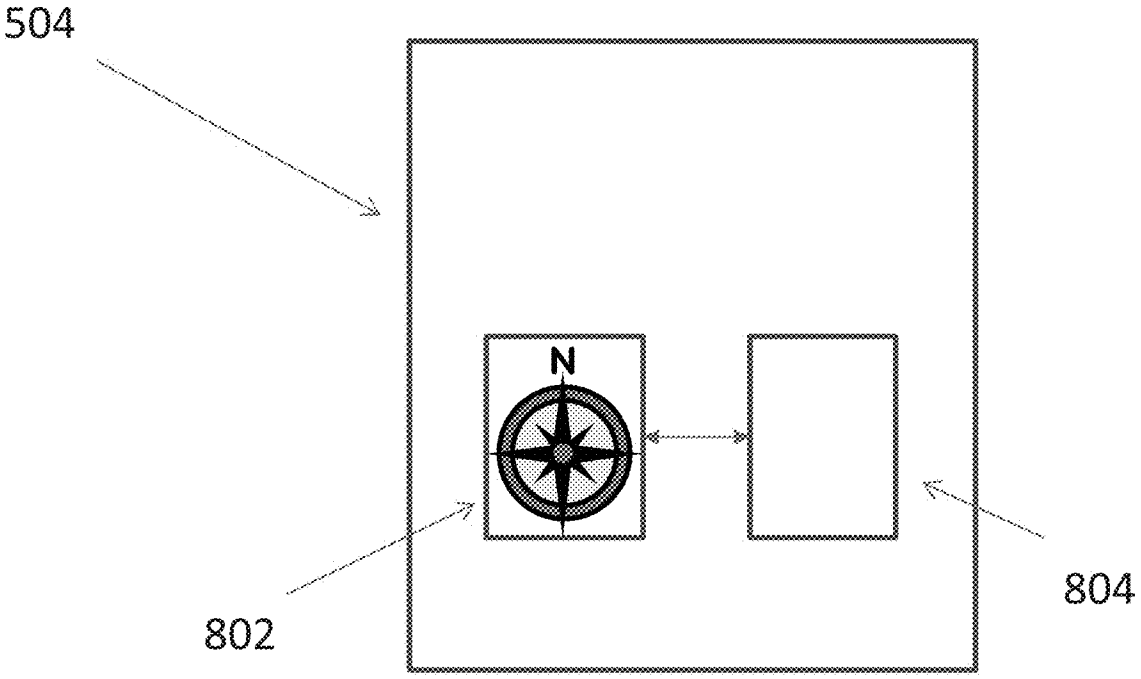
FIG. 8 illustrates a block diagram of an indicator device according to an embodiment of the invention.

Referring now to FIG. 8, an embodiment of indicator device 504 is shown. The indictor device includes at least a digital compass 802 and standard mobile device components 804 such as a processor, memory, input/output, battery, wireless and wired modem capability, etc. The invention is not limited to any specific architecture or configuration of these components other than as specifically noted. Indicator device 504 also includes some type of audio and/or visual indicator 806, although this may be part of standard components 804.

Figure 9:
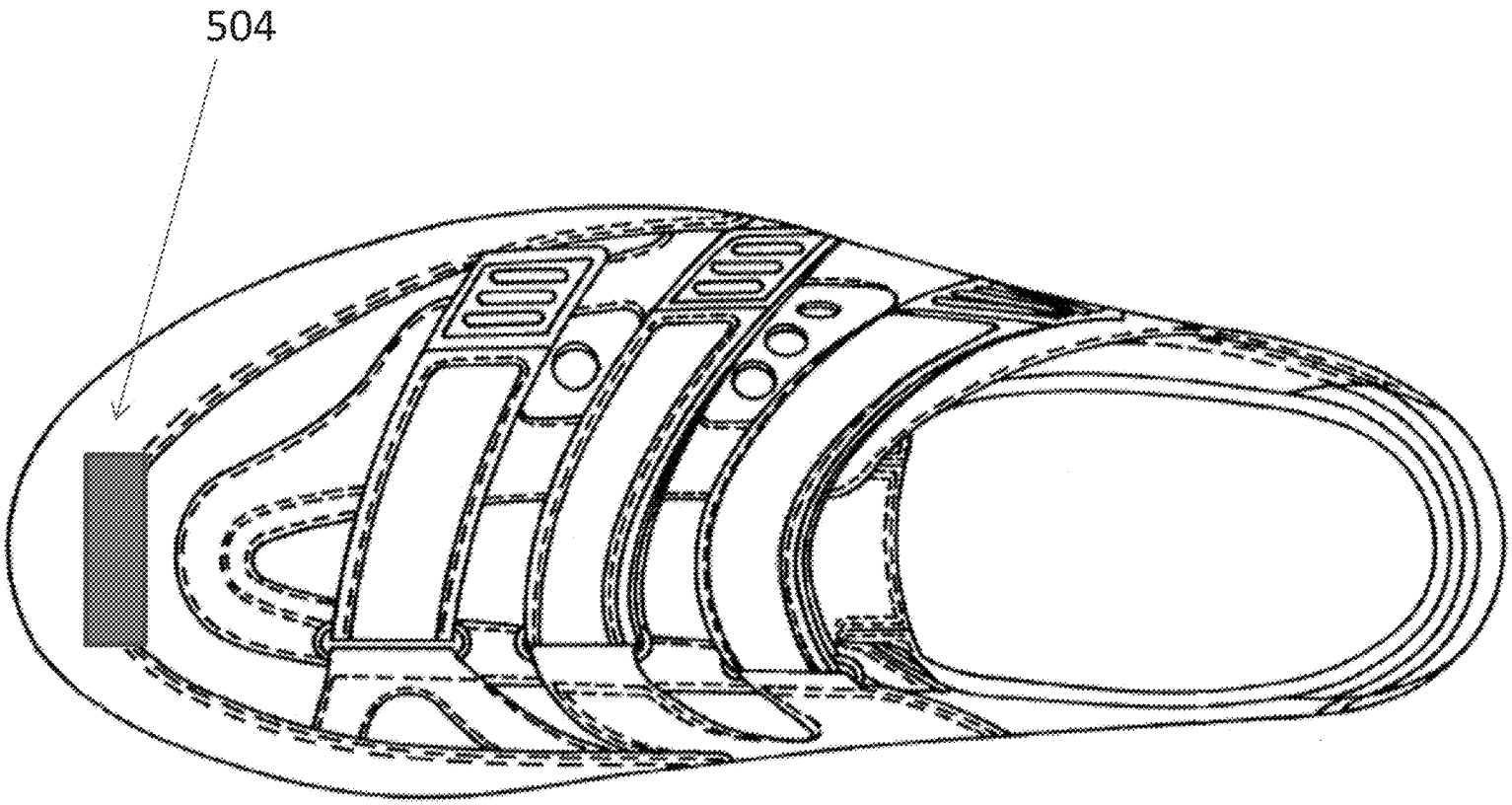
FIG. 9 illustrates a top view of the indictor device mounted on a shoe according to an embodiment of the invention.

Referring now to FIG. 9, the indicator device 504 is mounted on some frame of reference relative to the golfer. In one embodiment this frame of reference is the golfer's back shoe 902 in the golf stance (the right foot for right handed golfers, and the left foot for left handed golfers), as proper orientation of the foot tends to have a significant contribution to accuracy in the path that the golf ball 102 will take when struck. However, the invention is not so limited, and the indicator device 804 could be mounted on other parts of the golfer (e.g., a wrist mounted indicator), or the golf club itself. The mounting may be either temporary (e.g., clip on the laces, double sided adhesive to the shoe, or a receiving structure incorporated into the shoe) or permanent (integrated as part of the shoe and not removable absent destructive force). Indicator device 804 could also be separated into different components, such as the digital compass being mounted as noted and the indicator components being on another component that provides audio and/or visual input, such as a Bluetooth earpiece or Google Glasses.

Preferably the angle between the back-to-front direction of the shoe 902 is at a known angle to whatever reference the digital compass relies upon. This may be predetermined, or the orientation of the golfer's shoe may be calibrated with the indicator device 504; this is particularly useful when the mounting relationship is temporary. By way of example, a jig could be provided that (a) is aligned with a specific compass reference, such as true north, and (b) an area for receiving the shoe 902. The shoe 902 is then placed in the receiving area, and the indicator device 504 can then determine its angle relative to the shoe 902, and can account for the same in further processing.

Once the angle of the indicator device 504 relative to the shoe/foot is known, then the compass heading of the shoe 902 can be determined. In this way, the indicator device 504 can determine the directional heading of the shoe 902 relative to a desired orientation.

In operation, the indicator device 504 receives the compass heading as reported by the trajectory device 502; as discussed above, this represents the correct true heading from the spot at which trajectory device 502 noted the compass heading toward the target location that it aligned with. For proper orientation of the golfer to strike golf ball 102 along that correct true heading, the golfer's back foot should to be perpendicular to that compass heading. Indicator device 504 compares the direction heading of the shoe 902 relative to a perpendicular to the correct true heading and provides feedback to the golfer.

In practice it may be desirable to calibrate the two compasses together before play, such as by a common mounting device, to confirm that one would track the other. To the extent there is differential, this can be accounted for in the algorithm processing as discussed below. A log of compass headings may also be maintained for future reference.

Figure 1:
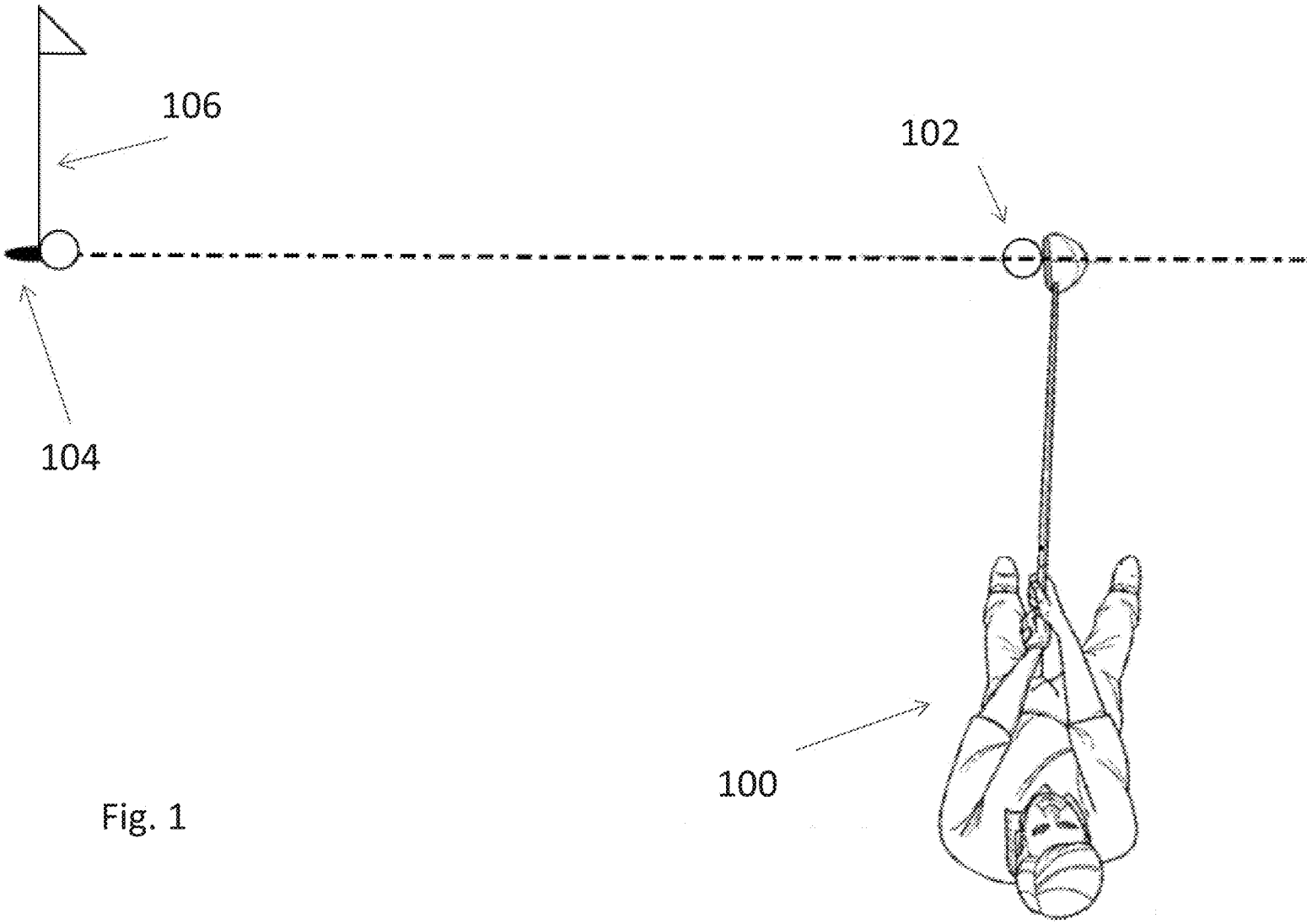
FIG. 1 illustrates an optimal alignment of a golfer to a target.
Figure 2:
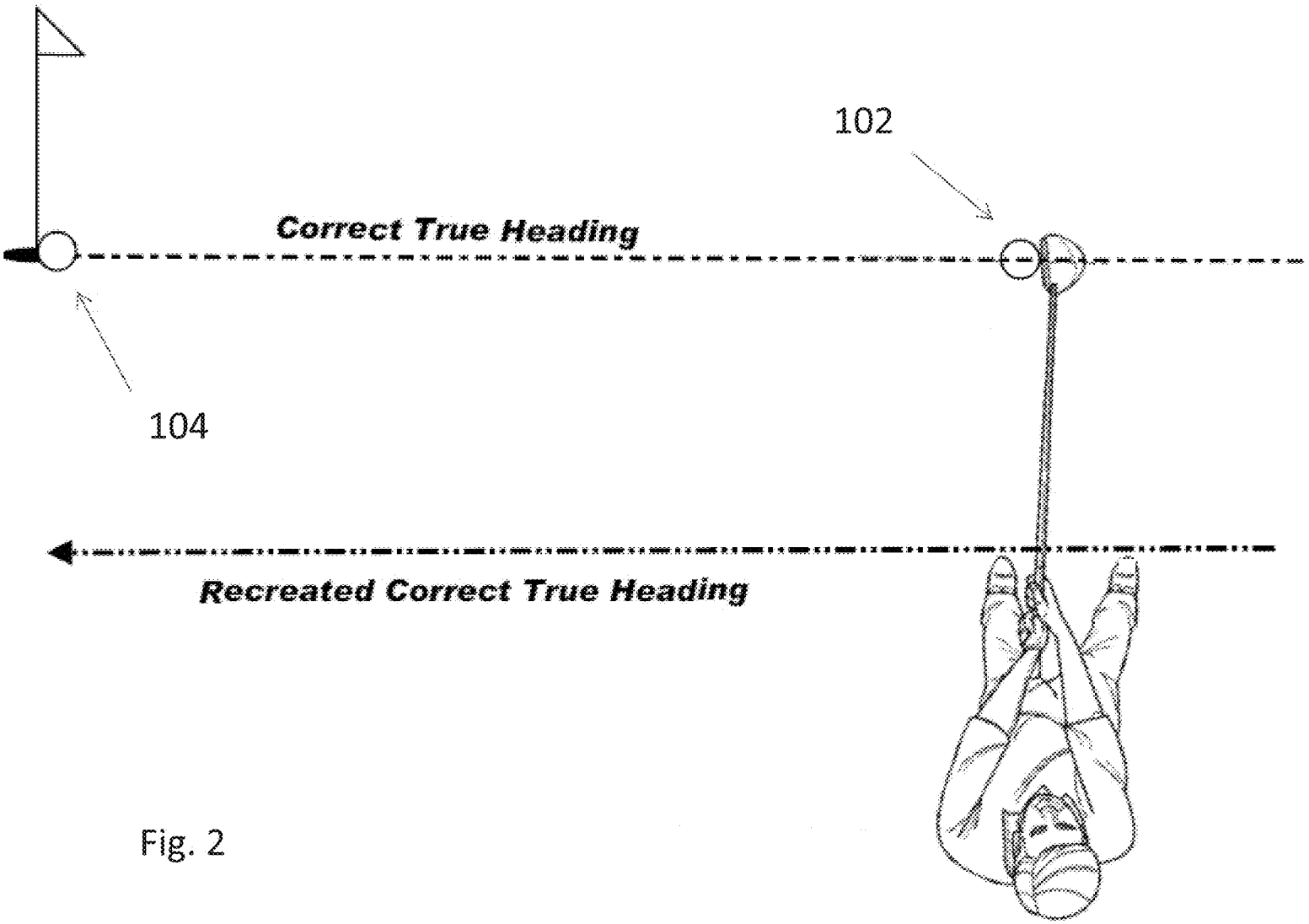
FIG. 2 illustrates an optimal alignment of the golfer to the target along with the correct true heading.
Figure 3:
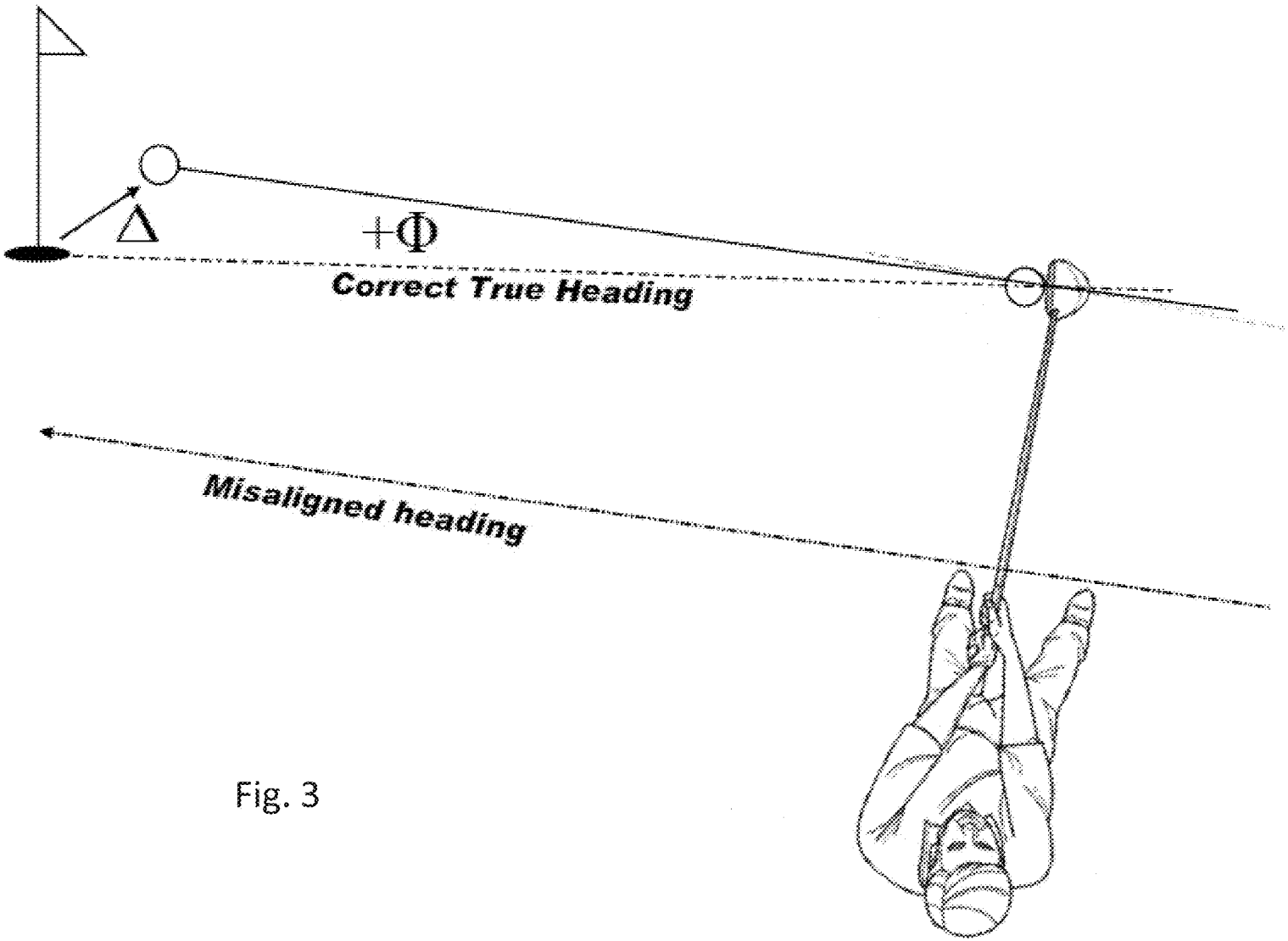
FIGS. 3 and 4 illustrate the impact of a misalignment between the golfer and the target.
Figures 3, 4:
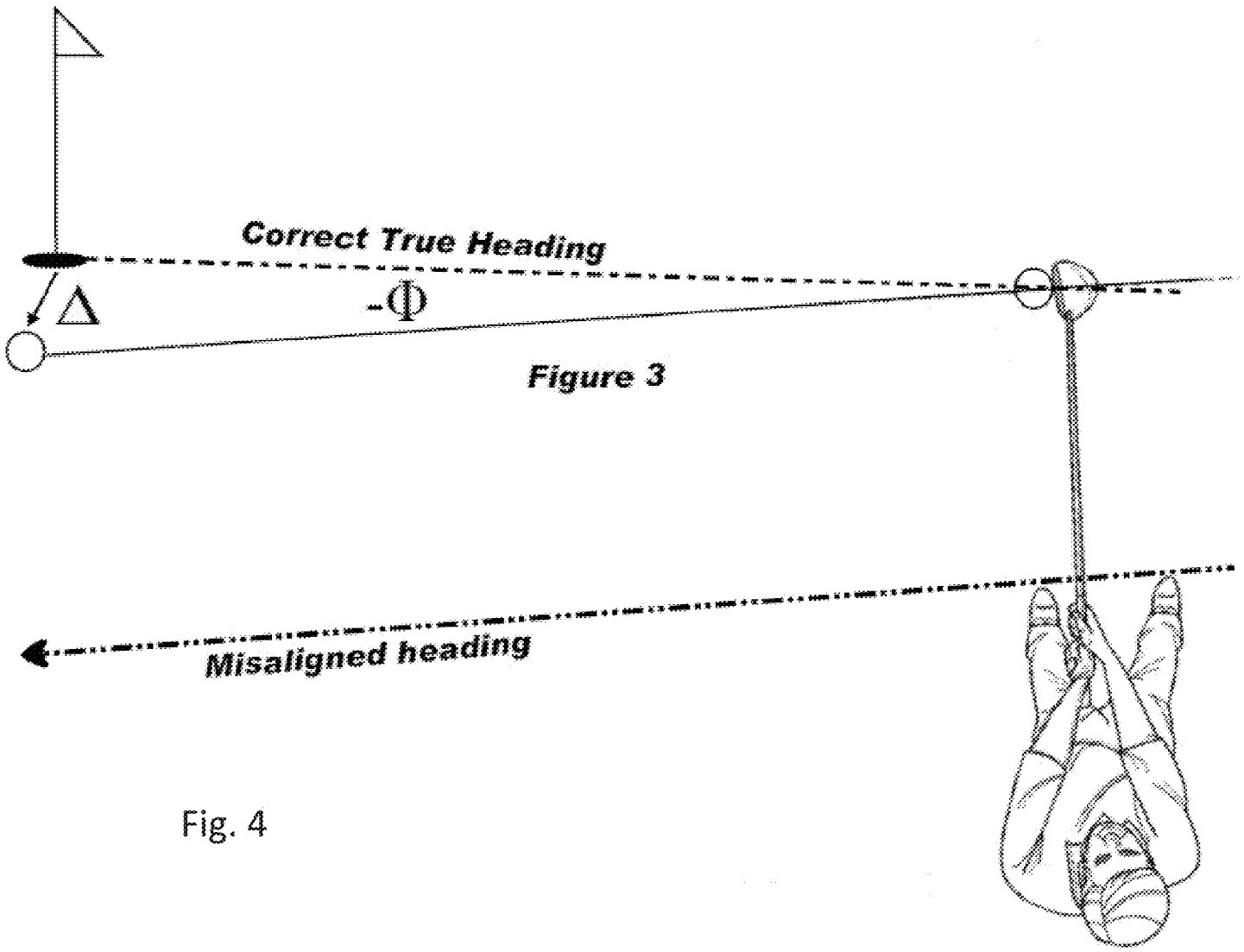

The feedback may be audio/or visual, and may be based on alignment or lack of alignment. For a non-limiting example of audio feedback, the indicator device 504 may emit a sound when the shoe is out of alignment as in FIGS. 3 and 4, and go silent when in the desired alignment in FIG. 2. For a non-limiting example of visual feedback may be an illuminated LED when out of alignment as in FIGS. 3 and 4, and changes to a blinking LED when in alignment as in FIG. 2. Note that the indicator 504 may indicate either alignment or misalignment both through specific action (e.g., sound, light) or inaction (e.g., silence, LED off); in this context the absence of an output is an "indicator".

It is noted that the orientation of the shoe is unlikely to ever be in perfect mathematical alignment with the correct true heading. "Perpendicular", or any special relationship as used and/or claimed herein should be understood as modified by "substantially" to allow for minor variations within the natural degree of error/approximation of the digital compass as well as the error of body placement. Indicator device 504 may be adjustable to modify the acceptable range of error.

In the above embodiments, the trajectory device 502 proves the data and the indicator device 504 processes the data. However, the invention is not so limited, and the processing can be performed at either device or a combination thereof. For example, the indicator device 504 could be transmitting its compass heading for the foot to the trajectory device 502, and the trajectory device 502 could be processing the optimal angles and providing an appropriate signal to the indicator components.

According to another embodiment of the invention, the trajectory device 502 and/or the indicator 504 may optionally include other sensors, laser ranging, barometric, wind, terrain inclination and/or other such measurements to assist in appropriate club selection. In yet another embodiment, the devices may receive that data from other sensors, e.g., there may be a local wind measurement station that can relay its information to one or both devices. Combinations of device mounted sensors and/or received information signals are also possible.

Figure 10:
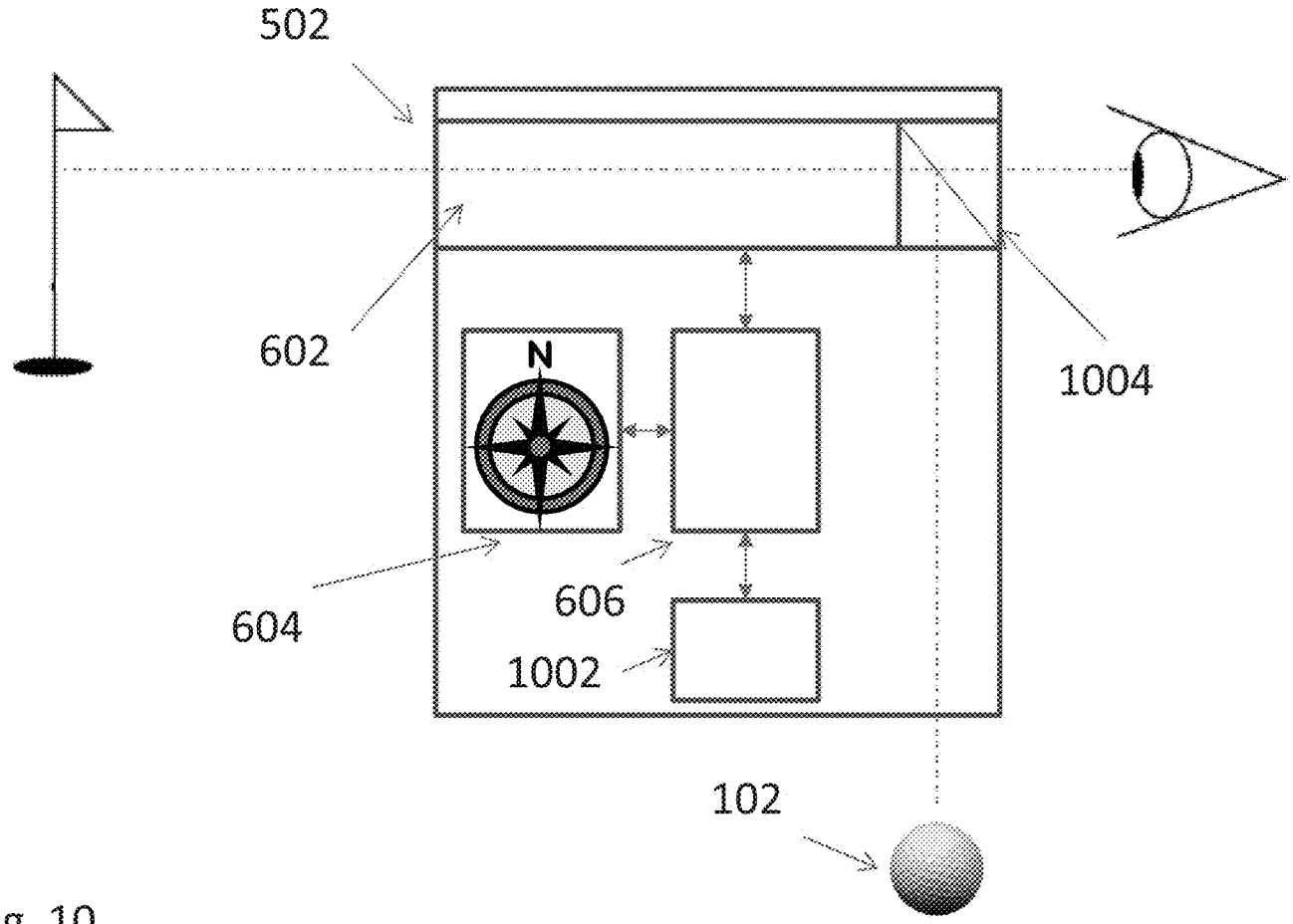
FIG. 10 illustrates a block diagram of a trajectory device according to another embodiment of the invention.

Some or all of these may be simply for informational purposes, and such information can be displayed on the display (if present). In the alternative, some or all may be used to determine whether to adjust the strike angle from the correct true heading to a different angle. For example, if the target location 104 is at a considerable distance with a strong wind going from left to right, trajectory device 502 may calculate that the optimum strike heading is a few degrees counterclockwise from the correct true heading. This optimum strike heading may be used by the above-noted embodiments as the heading to which the indicator device 504 sets the shoe 902 in the perpendicular relationship. FIG. 10 shows a non-limiting example of such a trajectory device 504 with 1002 representing additional sensors/components, the indicator device 504 would have a similar orientation. A beam splitter 1004 is also provided in the optical path 602 in FIG. 10 to illustrate the ability to view the ball 102 below trajectory device 502 as discussed above.

Figure 11:
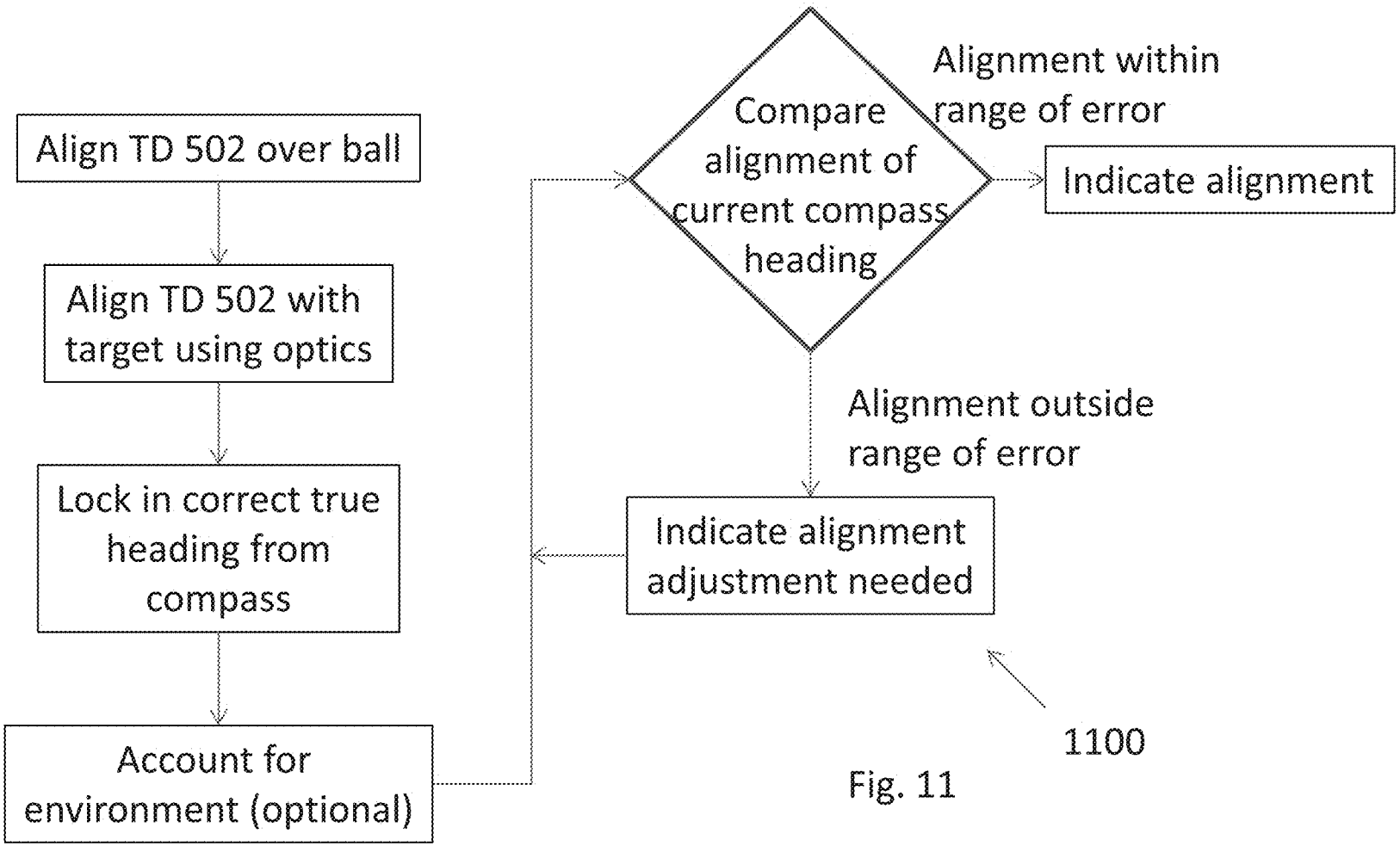
FIG. 11 illustrate a flowchart of the operation of an embodiment of the invention.

Referring now to FIG. 11, a flowchart 1100 showing the above described actions are shown. The actions need not occur in the order as shown in FIG. 11, and not all actions need be part of the invention.

According to another embodiment of the invention, the trajectory device 502 may determine heading without reliance on optics and/or a digital compass. For example, the position of a target, such as the pin, may be known or determinable, such as via GPS (as acquired or previously measured and stored in memory) or a beacon. The trajectory device can similarly determine its own location, e.g., via GPS. Using known methodology, a heading between the current position and the position of the target may be used as the correct true heading.

While an overwhelming number of golfers are right handed, there are a small number of left handed golfers. The embodiments herein may be preset for a right handed golfer. However, the invention is not so limited, and the trajectory device 502 and/or the indicator 504 may have an input for the golfer to indicate whether they are right or left handed, as this may impact the underlying alignments.

Figure 12:
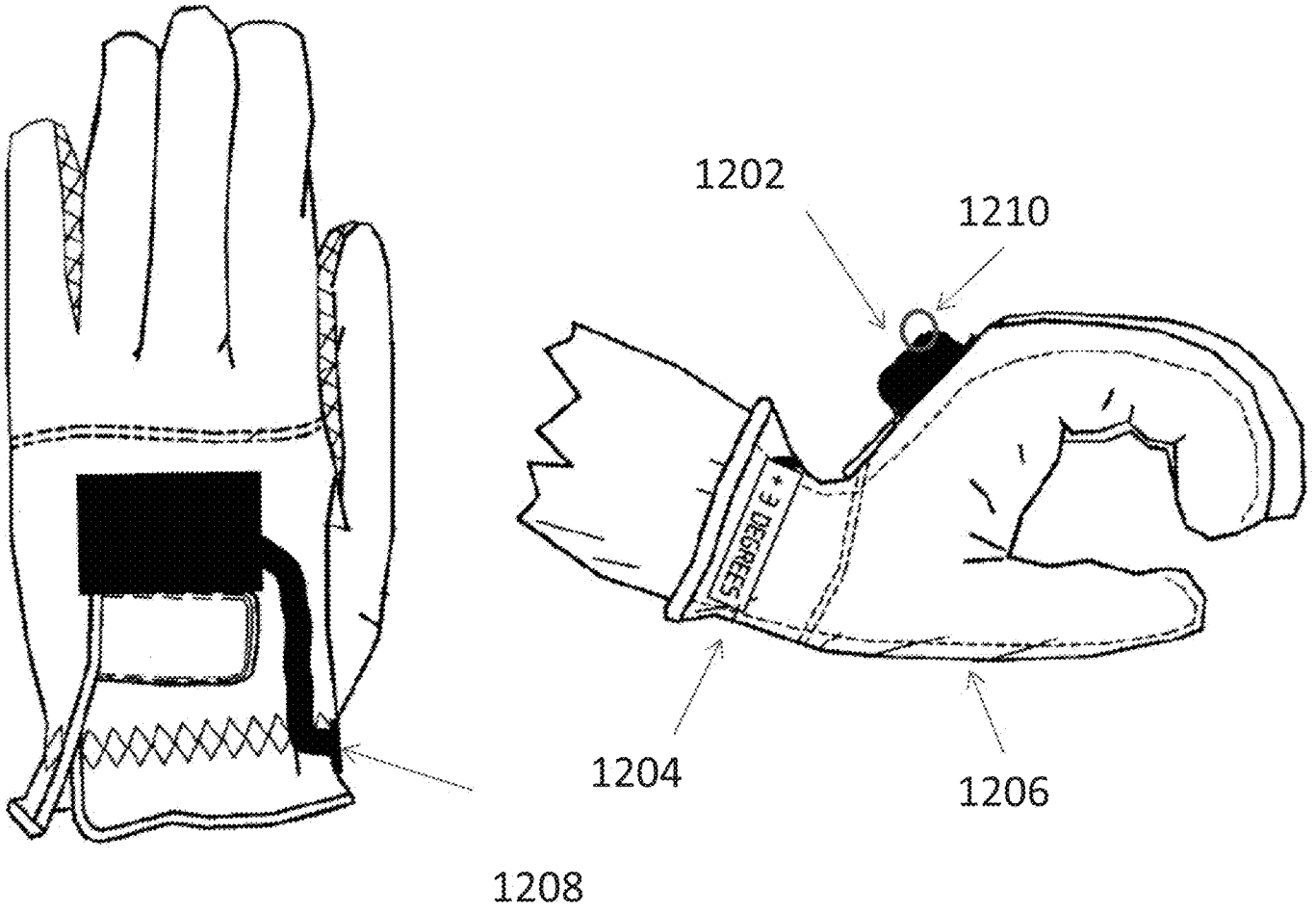
FIG. 12 shows another embodiment of the invention.
Figure 13:
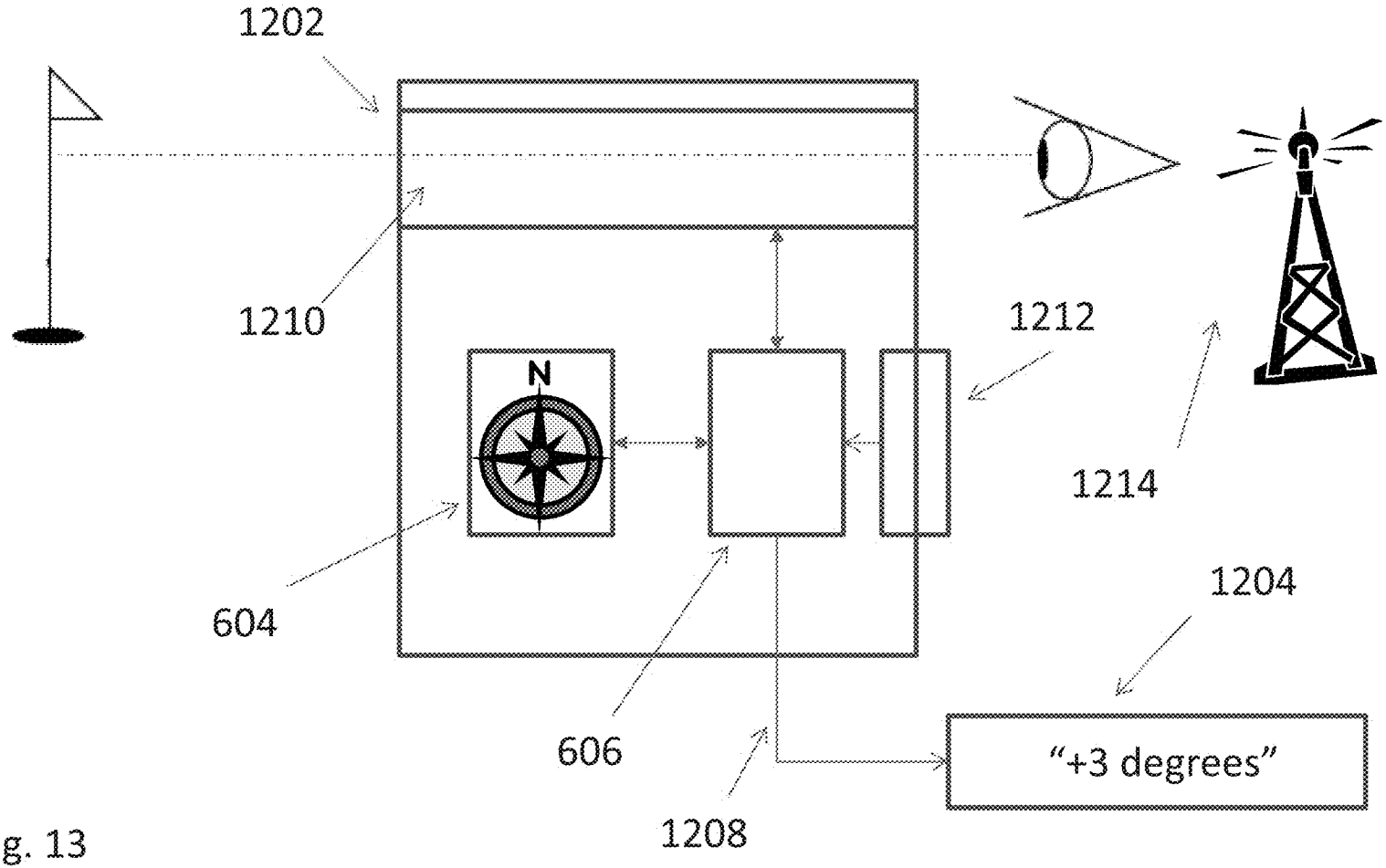
FIG. 13 shows a block diagram of another embodiment of the invention.

Referring now to FIG. 12, another embodiment of the invention is shown. The trajectory device 502 and the indicator device 504 are combined into a common structure 1202 with a display 1204 connected by a wiring harness 1208. The underlying components are consistent with the embodiments of FIGS. 5-11, although the common structure may prompt omission of duplicate components (e.g., only one compass 604 and set of computing components 606 are needed) and/or wireless communications (wired communications may suffice), although this need not be the case. As noted above, optional sensors 512 or information from external sources (shown collectively via 1214) may also be present to allow for measurement of external conditions.

The methodology of use parallels other embodiments. The golfer aligns his gloved hand over the ball and locates the target landing point 104 through the optics 1210. When aligned as desired, the golfer presses some trigger mechanism (or voice command) to lock the compass heading in for that orientation. The golfer then takes his stance as he prepares to strike the ball 102. For optimal alignment, the compass heading should show the back of the hand at 90 degrees to the stored compass heading for the correct true heading. If out of alignment, the system can similarly advise the golfer, such as in FIG. 12 by showing the amount of hand deviation to reach the desired orientation. When in this alignment, the system can alert the user via display 1204 or other visual/and or audio indicators.

The accuracy of the headings is based at least in part on two facts of the compass. The first is the quality and features of the compass used. For example, less expensive compasses tend to be more accurate when oriented in the horizontal, but degrade in accuracy when off that axis. Such compasses may be appropriate in stable environments such as the gun/shoe combination, but may be less preferably for a glove environment in which the position of the hand may be at various angles. The second is repeatability, which reflects how a compass will naturally give different readings for the same physical orientation. In some embodiments, such as the glove, the compass(es) will be in a different orientation and location between the first reading (during sighting) and the second reading (during the final alignment check prior to swinging the club).

In some implementations the corresponding degree of error may be acceptable, and thus no accommodations are necessary. For a desired higher performance there are several non-exclusive ways to improve this accuracy. One such method is selecting a higher quality compass with less off axis degradation and higher repeatability; by way of non-limiting example, the Honeywell tilt compensated HMC6343 magnetometer may be appropriate.

Other solutions relate to the physical environment that supports the compass to create alignment conditions that produce more accurate results. By way of non-limiting example, the compass may be positioned in a way such that at the angle of use (for sighting the target location and aligning the hand) is within a preferred range of deviation from optimal accurate alignment. Yet another would be for whatever mounts the compass to be physically adjustable (e.g., rotatable) between two different positions for the sighting and shot alignment, with each position being at (or within an acceptable range of deviation) position for best accuracy of the compass output; by way of non-limiting example, the two positions could be 90 degrees azimuth and 60 degrees elevation, respectively. Yet another would be for the sight to be physically adjustable and/or at an angle to the compass, such that the compass position during sighting was more consistent with the position for the alignment. Combinations of these approaches could also be used.

The above embodiments show at least a portion of the device on wearable support, such as a glove or shoe. However, the invention is not so limited, and other supports could be used. The mounting can be permanent, removable, or interchangeable in whole or in part. Individual components, such as the optical system, may also have a permanent, removable, or interchangeable mount/connection.

The comparison of the two compass headings is typically subject to algorithmic processing within components 606, which indicates whether or not the proper "alignment" exists, e.g., the body part (e.g., hand, foot) is at the substantially proper position relative to the correct true heading from the first compass heading. At a most basic level, it is possible that the two compass headings would be taken from the same physical angle, such that the algorithm is simply a comparison of the two headings to determine whether they are the same (subject the margin of error), or within a predetermined "close enough" setting.

However, a more likely methodology would have the position of the compass at different physical angles that requires a degree of offset. By way of non-limiting example, the embodiment of FIGS. 11-12 would tend to have a 90 degree difference between the correct true heading from the first compass heading to the second compass heading when the golfer's hand is in proper position. The golfer's hand would be considered in proper alignment when the two compass headings were at substantially 90 degrees difference. Consideration of external factors, such as wind speed, temperature, etc., would also be algorithmically taken into account. The exact algorithm would be specific to location/orientation of the compass in its position for the two compass headings, as well as any external conditions to the extent taken into account.

The algorithm is preferably carried out by components 606, but it is possible that some or all of these computations could be performed by a remote device, such as a server.

The various devices herein may include movement sensors to indicate when the devices are in motion. During the sighting and alignment phases, the golfer will be relatively still. The movement sensors can thus disable the system when in motion, thus conserving battery power and/or preventing the indicators from presenting information when otherwise not in use. A timer can also be used to disable the system after a set time from when the trajectory is measured.

The specification and drawings are, accordingly, to be regarded in an illustrative rather than a restrictive sense. It will, however, be evident that various modifications and changes may be made thereunto without departing from the broader spirit and scope of the invention as set forth in the claims.

What is claimed is:

1. A golfing aid system at least partially configured to be mounted on a golfer, comprising:

an output interface configured to provide audio and/or visual information;

a human wearable support in the form of a glove or a shoe;

a first compass mounted on the wearable support;

an optical system mounted on the wearable support;

the golfing aid system being configured to, when the wearable support is worn by the golfer;

obtain a first compass heading from the first compass for a target location observable through the optical system when the golfer is not in a golfing stance;

obtain a second compass heading when the golfer is in a golfing stance;

determine, based on at least the first and second compass headings, whether a part of the body that supports the human wearable support is substantially in alignment with a direction; and provide feedback through the output interface, the feedback being configured to indicate whether or not the golfer is substantially aligned with the direction;

wherein the direction represents a substantially optimal alignment of a part of the body relative to the first compass heading to strike a golf ball along a path in alignment with the first compass heading.

2. The system of claim 1, wherein the support is a glove.

3. The system of claim 1, wherein the first and second compass heading is taken from the first compass.

4. The system of claim 1, wherein the output interface is physically connected to the wearable support.

5. The system of claim 1, further comprising: a second compass, wherein the second compass is mounted to a hand-held device distinct from the wearable support; and the first compass heading is taken from the second compass and the second compass heading is taken from the first compass.

6. The system of claim 1, wherein the determining is additionally based on at least one environmental factor, the at least one environmental factor including local wind that could alter trajectory of a golf ball in flight.

7. The system of claim 1, wherein the determine comprises determines whether the first compass heading differs from the second compass heading by a predetermined value with a predetermined margin of error.

8. A golfing aid system at least partially configured to be mounted on a golfer, comprising:

a hand held device, including:

an optical system; and a first compass;

the handheld device being configured to determine a first compass heading from the first compass of the handheld device toward a target location observable through the optical system when the golfer is not in a golfing stance;

a human wearable support in the form of a glove or a shoe, distinct from the hand held unit, including:

a second compass;

an output interface configured to provide audio and/or visual information;

the golfing aid system being configured to, when the wearable support is worn by the golfer;

obtain a second compass heading from the second compass when the golfer is in a golfing stance;

determine, based on at least the first and second compass headings, whether the part of the body that supports the human wearable support is substantially in optimal alignment to drive a ball to the target location; and provide feedback through the output interface, the feedback being configured to indicate whether or not the golfer is substantially aligned with the first compass heading.

9. The system of claim 8, wherein the support is a glove.

10. The system of claim 8, wherein the output interface is a display.

11. The system of claim 8, wherein the output interface is configured to indicate how far out of alignment the wearable support is.

12. The system of claim 8, wherein the output interface is mounted on the hand held device, the wearable support, or a distinct component.

13. The system of claim 8, wherein the determine is additionally based on at least one environmental factor, the at least one environmental factor including local wind that could alter trajectory of a golf ball in flight.

* * * * *